US008475604B2

(12) United States Patent
Clement et al.

(10) Patent No.: US 8,475,604 B2
(45) Date of Patent: Jul. 2, 2013

(54) TANK CLEANING DEVICE AND METHOD

(75) Inventors: Keith Clement, Jennings, LA (US); Charles Rulon, Lake Charles, LA (US)

(73) Assignee: Omni Energy Services Corp., Lafayette, LA (US)

( * ) Notice: Subject to any disclaimer, the term of this patent is extended or adjusted under 35 U.S.C. 154(b) by 397 days.

(21) Appl. No.: 12/695,264

(22) Filed: Jan. 28, 2010

(65) Prior Publication Data

US 2011/0180111 A1 Jul. 28, 2011

(51) Int. Cl.
*B08B 9/00* (2006.01)

(52) U.S. Cl.
USPC ..... 134/167 R; 134/166 R

(58) Field of Classification Search
None
See application file for complete search history.

(56) References Cited

U.S. PATENT DOCUMENTS 2,919,094 A * 12/1959 Petrick ..... 248/171
5,555,939 A * 9/1996 Berger et al. ..... 169/54
6,189,811 B1 * 2/2001 Rudy ..... 239/375
6,213,134 B1 * 4/2001 Pike ..... 134/166 R
6,858,090 B2 2/2005 Hebert
7,044,144 B2 5/2006 Hebert
2008/0047587 A1 2/2008 Ball

* cited by examiner

*Primary Examiner* — Eric Golightly
(74) *Attorney, Agent, or Firm* — Warner J. Delaune; Baker Donelson

(57) ABSTRACT

A tank cleaning device is provided, comprising a base member; a conduit attached to the base member having an inlet, an upper outlet, and a lower outlet; and a plurality of adjustable legs connected to and extending below the base member. The inlet of the conduit accepts a cleaning fluid, and a cleaning nozzle is attached to either the upper outlet or the lower outlet. A method of cleaning the tank is also provided, comprising placing the mounting device at a first location, spraying the tank with the cleaning fluid until a selected portion of the tank is cleaned, discontinuing the supply of cleaning fluid, and then repositioning the mounting device to a second location within the tank and resuming the supply of cleaning fluid. Multiple mounting devices may be employed and periodically repositioned within the tank to achieve quick and effective cleaning.

11 Claims, 5 Drawing Sheets

TANK CLEANING DEVICE AND METHOD

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON COMPACT DISC

Not applicable.

BACKGROUND OF THE INVENTION

1. Field of the Invention

The present invention relates to devices used to clean tanks and other containers, including but not limited to storage tanks, marine vessels, and similar equipment. The invention is more particularly suited to cleaning the interior surfaces of such tanks using multiple spraying devices installed on repositionable mounts within the tank.

2. Description of Related Art

Tanks, containers and other similar enclosures are commonly used to store liquids in any number of different applications. Tanks of varying sizes and shapes are frequently used to store liquids in connection with numerous industries including, but not necessarily limited to, the oil and gas industry. Such tanks are especially prevalent in the offshore oil and gas industry, in particular, where they are often used to store different types of fluids on boats and drilling rigs.

In many cases, tanks on boats and drilling rigs are used to store and transport drilling fluids. Such drilling fluids often contain chemicals and other additives designed to adjust or control certain characteristics of the fluids. Common drilling fluid additives include gelling agents (e.g., colloidal solids or emulsified liquids), weighting materials (e.g., barite or bentonite, etc.), and other chemicals which are used to maintain fluid properties within desired parameters. Further, although drilling fluids have historically been water-based, improved results have been obtained using oil-based or synthetic-based drilling fluids, especially in severe drilling environments. Many of these additives, as well as oil-based and synthetic-based drilling fluids, can be harmful to personnel and the environment.

Different stages of the drilling process may require different types of drilling fluids having different characteristics. In such cases, the limited tank capacity of boats and drilling rigs necessitates using the same tanks to store such different drilling fluids. However, because such different types of drilling fluids may not be compatible with one another, it is frequently necessary to clean such tanks before switching the fluids to be stored in such tanks.

The process of cleaning tanks can often prove to be difficult, expensive and time consuming. Such cleaning can be especially challenging when solids are permitted to drop out of suspension. In such cases, solids are often deposited in the tanks, forming hardened layers at or near the bottom of such tanks that cannot be simply drained from the tanks. Frequently, such deposited solids must be removed before interior surfaces of the tanks can be cleaned.

Personnel are often utilized to manually clean storage tanks on boats and drilling rigs. In such cases, personnel are required to physically climb inside the tanks and use suction hoses, hand-held pressure washers, shovels, and other tools to clean the interior surfaces of the tank. This is a highly labor intensive endeavor, particularly when hardened deposits of solids are present, and when such personnel are required to wear suitable protective equipment. The difficulty of such work is often exacerbated on hot days when temperatures inside the tanks can be uncomfortably high with poor ventilation. Further, this method of cleaning tanks raises safety concerns, because personnel inside the tanks are frequently exposed to drilling fluid residue, toxins and contaminants that may be present within such tanks.

Various automated tank cleaning devices have been developed in an attempt to eliminate the numerous problems associated with manual cleaning of tanks, such as tanks located on boats and drilling rigs. However, performance of such prior art cleaning devices has proven to be less than satisfactory, often because such prior art cleaning devices cannot adequately reach all areas of tanks to be cleaned. Furthermore, most chemical compounds used in connection with prior art automated cleaning devices are ineffective at removing solids from tanks being cleaned. Moreover, prior art devices can be cumbersome, as well as difficult and expensive to operate.

One automated technique for cleaning storage tanks utilizes a programmable pressure washer that can be permanently mounted to the tank shell, or inserted through a permanently installed fitting. These systems usually include a rotating washer head that is provided with one or more nozzles that are moved automatically to make the wash head cover a specified area. These pressure washers are normally adapted to be installed in a fixed position relative to the tank with the wash head providing all the movement required.

In general, the tank geometry, including any internal obstructions, and the distribution of deposits make it difficult to match the washing pattern of a single washing head to a specific tank configuration because with the types of washing systems described above, some areas are more intensely washed than others. Further, so-called "shadow" areas that are shielded from the direct impact of the jet by pipe, stanchions, baffles and the like, are not well cleaned. Therefore, many of the systems described above employ several washing heads simultaneously and may operate for extended periods of time, such that excess consumption of washing liquid may occur. This excess consumption of washing liquid represents a poor exploitation of time, an increased energy cost, possibly an undesired wear on the tank interior, and it involves an increased cost of purifying the waste liquid which is discharged in larger quantities than may be necessary. Further, in many cases, access is limited to a manway or other large openings in the tank, and nozzles positioned only at these locations cannot completely clean tanks with shadowed areas.

Accordingly, there is a need for an efficient and effective automated system for cleaning tanks and similar enclosures, including tanks containing solids-laden fluids and hardened deposits of solids. Such system should permit cleaning of entire tanks or other enclosures, and should minimize the need for personnel to physically enter such tanks or other enclosures by employing multiple repositionable spraying devices to be employed at several locations within the tank. It is believed that the apparatus and method described and claimed herein directly address these needs.

SUMMARY OF THE INVENTION

A tank cleaning mount is provided, comprising a base member; a conduit attached to the base member having an inlet adapted to accept a supply of cleaning fluid, an upper outlet, and a lower outlet; and a plurality of support members connected to and extending below the base member. The base member preferably includes an upper plate removably connected to a lower plate. The inlet and the upper outlet of the conduit extends above the upper plate, while the lower outlet of the conduit extends below the lower plate. Both of the upper outlet and the lower outlet are adapted to accept a cleaning nozzle.

In a preferred embodiment, the mount includes at least four of the support members or legs, and each of the support members includes a bottom pad for making contact with the floor of the tank or vessel.

Preferably, one or more of the support members is lockably and pivotally connected to the base member, with each support member being lockable in two or more positions by a removable pin inserted into holes formed in the leg brackets. Optionally, one or more of the support members may be telescopingly adjustable to assist in leveling the mounting device on the floor of the tank in the presence of accumulated solids.

It is preferred that the inlet of the conduit be oriented at an upward angle relative to the base member so that the downwardly extending supply hose can be attached easily and with a minimal transition. Also, for ease of connecting the supply hose and cleaning nozzles, the inlet, the upper outlet, and the lower outlet of the conduit each include a quick connect coupling.

A method of cleaning a tank is also provided, comprising: (a) providing at least one mounting device to a first location within a tank, wherein the mounting device includes a base member; a conduit having an inlet, an upper outlet, and a lower outlet; and a plurality of support members connected to and extending below the base member; (b) providing a cleaning nozzle operatively attached to the conduit, and supplying a cleaning fluid to the inlet; and (c) spraying the tank with the cleaning fluid until a selected portion of the tank is cleaned.

In most cases, the method will also include: (d) discontinuing the supply of cleaning fluid; and (e) repositioning the mounting device to a second location within the tank and resuming the supply of cleaning fluid.

Similarly, to achieve faster cleaning of the tank or vessel, at least two of the mounting devices may be placed within the tank, wherein such mounting devices are periodically repositioned within the tank until the tank is clean.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
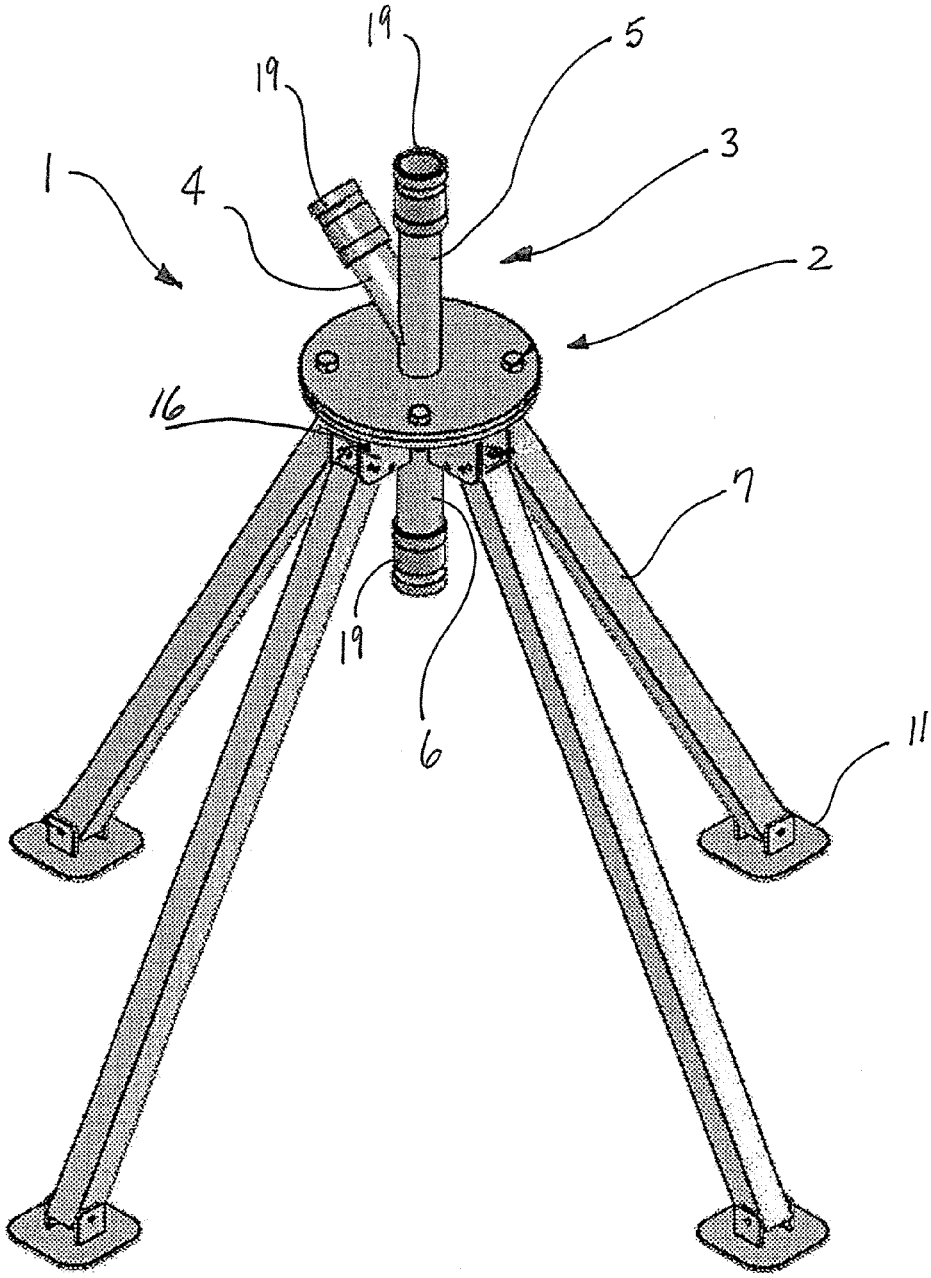
FIG. 1 shows a perspective view of a preferred embodiment of the present invention.
Figure 2:
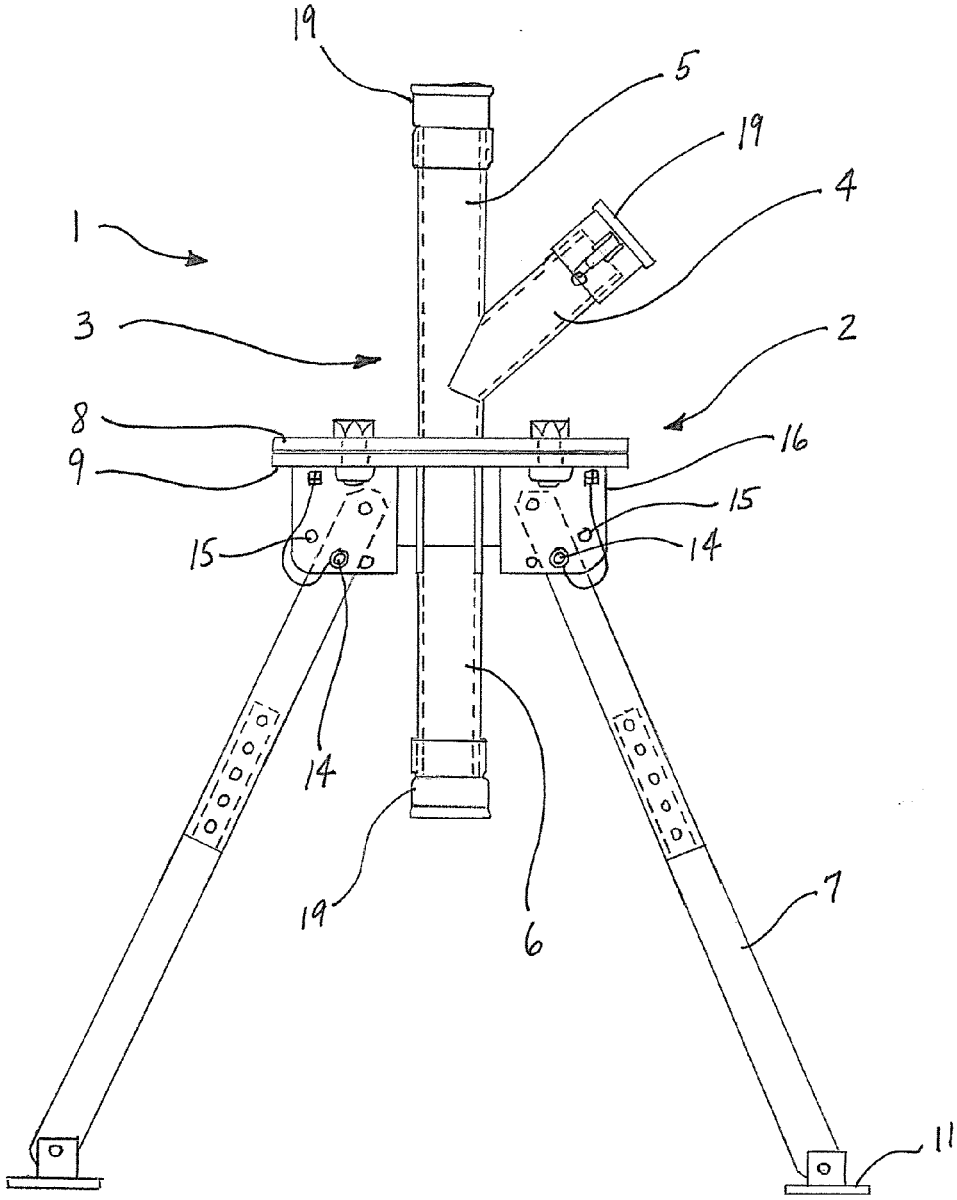
FIG. 2 shows an elevation view of the embodiment of FIG. 1.

Turning now to FIGS. 1 and 2, a tank cleaning mount 1 is provided, comprising a base member 2; a conduit 3 attached to the base member 2 having an inlet 4 adapted to accept a supply of cleaning fluid, an upper outlet 5, and a lower outlet 6; and a plurality of support members 7 connected to and extending below the base member 2. The base member 2 preferably includes an upper plate 8 removably connected to a lower plate 9 by a plurality of screws, bolts or similar fasteners. The inlet 4 and the upper outlet 5 of the conduit 3 extends above the upper plate 8, while the lower outlet 6 of the conduit 3 extends below the lower plate 9. Both of the upper outlet 5 and the lower outlet 6 are adapted to accept a cleaning nozzle 10.

In the elevation view of the mount 1 in FIG. 2, the front and rear legs 7 are removed for clarity, with the understanding that the left and right legs 7 illustrate identical hardware and fasteners for the front and rear legs 7.

In a preferred embodiment, the mount 1 includes at least four of the support members or legs 7, and each of the support members 7 includes a bottom pad 11 for making contact with the floor 12 of the tank or vessel 24.

Figure 3:
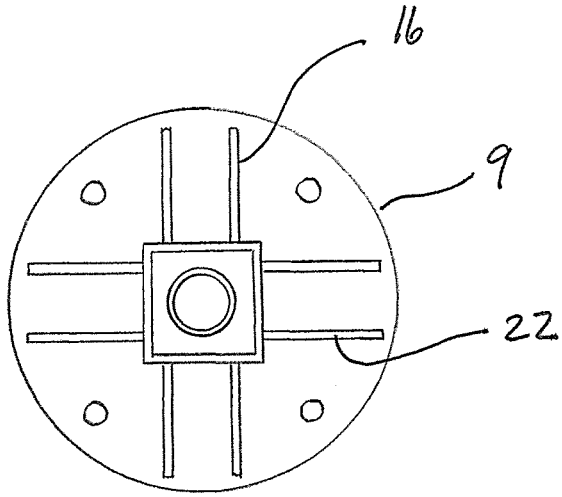
FIG. 3 shows a bottom view of the lower plate assembly of FIG. 2.

Preferably, one or more of the support members 7 is lockably and pivotally connected to the base member 2, with each support member 7 being lockable in two or more positions by a removable pin 14 inserted into holes 15 formed in the leg brackets 16, also as shown in FIG. 3. Optionally, one or more of the support members 7 may be telescopingly adjustable to assist in leveling the mounting device 1 on the floor 12 of the tank 24 in the presence of accumulated solids 17.

It is preferred that the inlet 4 of the conduit 3 be oriented at an upward angle relative to the base member 2 so that the downwardly extending supply hose 18 can be attached easily and with a minimal transition. Also, for ease of connecting the supply hose 18 and cleaning nozzles 10, the inlet 4, the upper outlet 5, and the lower outlet 6 of the conduit 3 each include a quick connect coupling or "camlock" connection 19.

Figure 4:
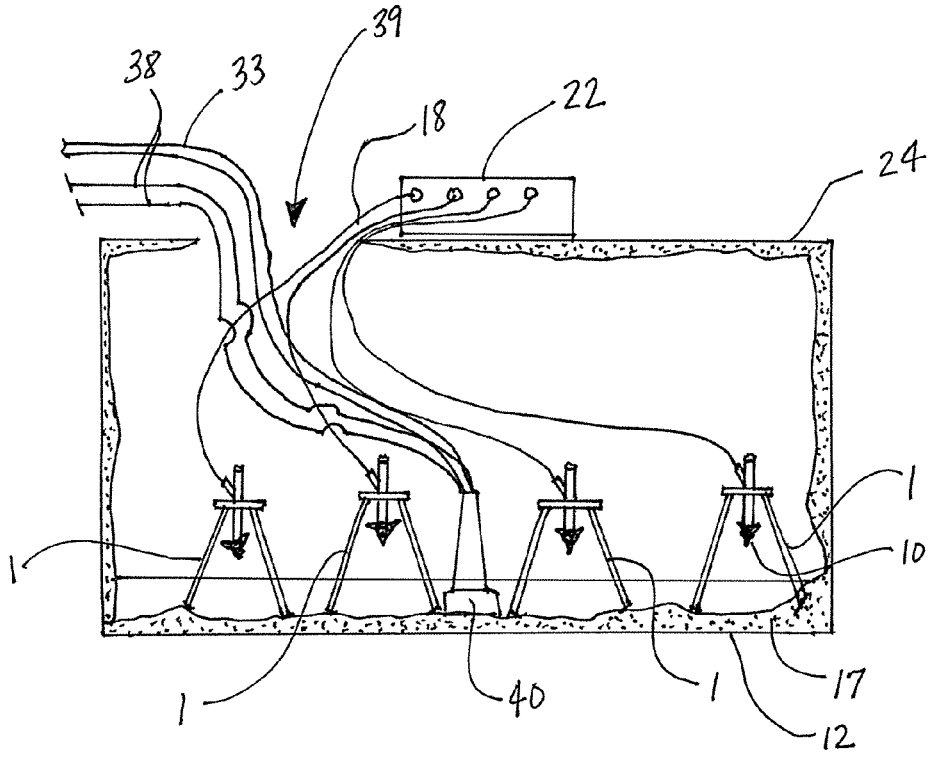
FIG. 4 shows the embodiment of FIG. 1 in an operating configuration within a tank being cleaned.

A method of cleaning a tank 24 is also provided, comprising: (a) providing at least one mounting device 1 to a first location within a tank 24, wherein the mounting device 1 includes a base member 2; a conduit 3 having an inlet 4, an upper outlet 5, and a lower outlet 6; and a plurality of support members 7 connected to and extending below the base member 2; (b) providing a cleaning nozzle 10 operatively attached to the conduit 3, and supplying a cleaning fluid 18 to the inlet 4; and (c) spraying the tank 24 with the cleaning fluid until a selected portion of the tank 24 is cleaned. FIG. 4 depicts several of the tank cleaning mounts 1 within a typical tank 24 being cleaned.

In most cases, the method will also include: (d) discontinuing the supply of cleaning fluid; and (e) repositioning the mounting device 1 to a second location within the tank 24 and resuming the supply of cleaning fluid.

Similarly, to achieve faster cleaning of the tank or vessel 24, at least two of the mounting devices 1 may be placed within the tank 24, wherein such mounting devices 1 are periodically repositioned within the tank 24 until the tank 24 is clean, as shown in FIG. 4. Specifically, multiple tank cleaning mounts 1 can be positioned so that their respective cleaning patterns can overlap, thus allowing the tank 24 to be cleaned more quickly without necessarily having to reposition to mounts 1.

Figure 5:
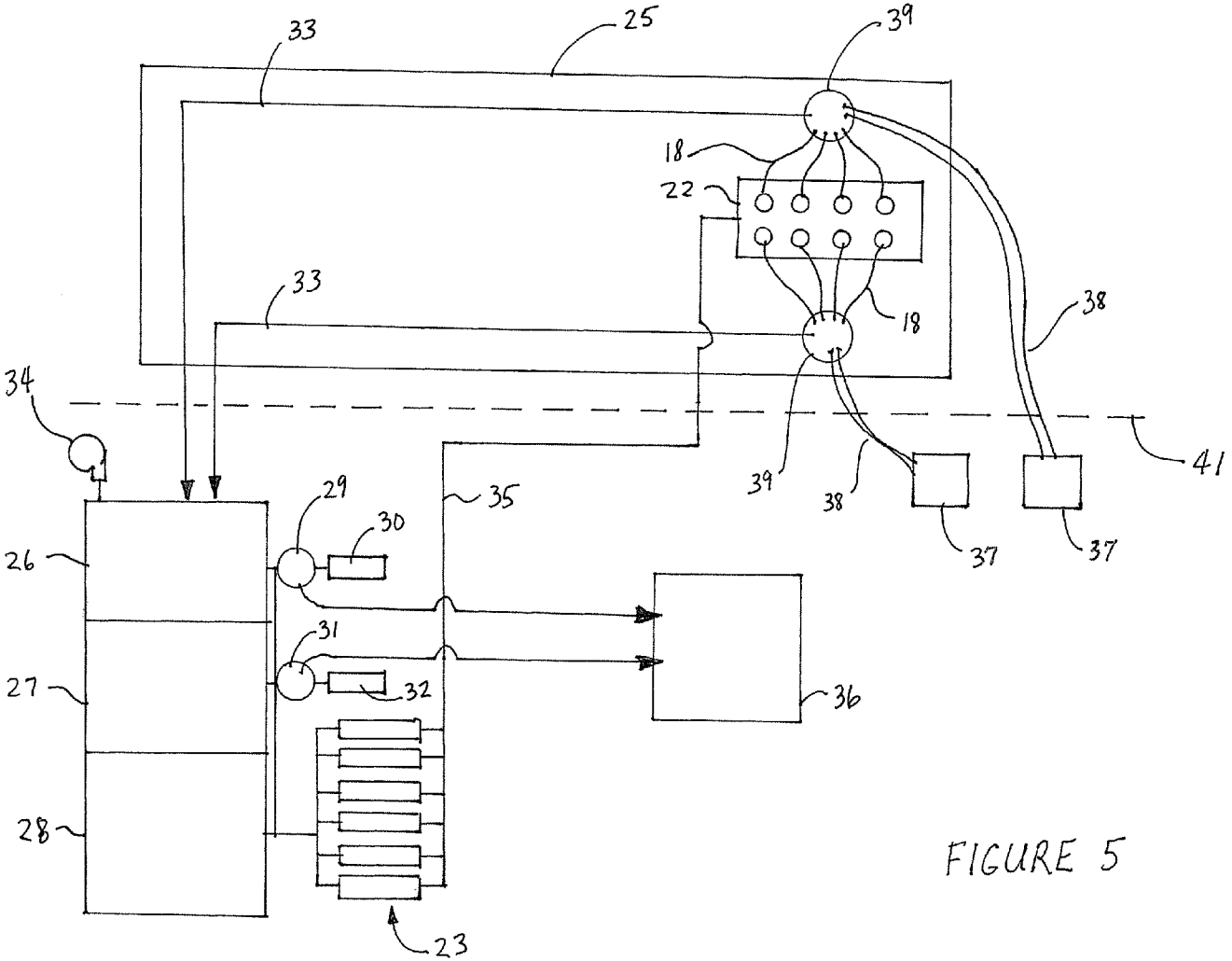
FIG. 5 shows an example of how multiple devices may be used in connection with other components of a cleaning system for tanks and vessels.

With reference to FIGS. 4 and 5, the tank cleaning mounts 1 are shown in connection with other components of a tank cleaning system in accordance with the invention. Specifically, multiple mounts 1 are shown within the tank 24, wherein each mount 1 is supplied with cleaning fluid via supply hoses 18. The supply hoses 18 are connected to a portable manifold 22, which can accommodate many outlets for multiple mounts 1. In FIG. 5, a manifold with eight (8) connections is illustrated, but it will be understood that such manifold 22 may include more or less outlets as needed. During the cleaning process, cleaning fluid and dissolved or dislodged solids 17 are pumped from the tank 24 through waste return line 33 by one or more hydraulic pumps 40.

Referring to FIG. 5, it can be seen that the tank 24 can be one of several tanks within a larger vessel 25, such as a barge located adjacent to a dock 41. The portable manifold 22 is positioned on the vessel 25 above the tank openings 39. Supply hoses 18 from the manifold 22 extend into the tank 24 to the mounts 1 as described above with respect to FIG. 4. In the configuration of FIG. 5, the manifold 22 is supporting up to eight (8) mounts 1 within the tank 24, and there are two (2) hydraulic pumps 40. Each hydraulic pump 40 is powered by hydraulic supply and return lines 38 extending from hydraulic power units (HPU's) 37, which are located on the adjacent dock 41. Waste return lines 33 extend from each of the hydraulic pumps 40 and deliver used cleaning fluid and solids 17 to a series of processing tanks located on the dockside 41 so that it can be recycled as explained below.

Specifically, the processing tanks include a desander pit 26, a desilter pit 27, and a clean water tank 28. A desander 29 and associated desander pump 30 remove sand from the waste fluid and deliver the sand to a portable waste tank 36. Similarly, a desilter 31 and associated desilter pump 32 remove silt from the waste fluid and deliver the silt to the portable waste tank 36. The resulting clean water from clean water tank 28 is then used to supply the dockside electric pressure pumps 23 arranged in a parallel configuration as shown in FIG. 5. Clean washing fluid is then directed to the manifold 22 on the vessel 25 via pressure hose 35.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A tank cleaning device, comprising:

a base member adapted to retain a vertical conduit;

a vertical conduit attached perpendicularly to the base member, the conduit having an inlet, an upper outlet, and a lower outlet, wherein the upper outlet extends vertically above the base member, wherein the lower outlet extends vertically below the base member, and wherein the inlet extends diagonally from the upper outlet; and a plurality of support members connected to and extending below the base member.

2. The device of claim 1, wherein the base member includes an upper plate removably connected to a lower plate.

3. The device of claim 1, wherein the inlet is adapted to accept a supply of cleaning fluid.

4. The device of claim 1, wherein the upper outlet and the lower outlet are each adapted to accept a cleaning nozzle.

5. The device of claim 1, further including at least four of the support members extending below the base member.

6. The device of claim 1, wherein one or more of the support members includes a bottom pad.

7. The device of claim 1, wherein one or more of the support members is lockably and pivotally connected to the base member.

8. The device of claim 7, wherein the support members are lockable in two or more positions.

9. The device of claim 1, wherein the inlet of the vertical conduit is oriented at an upward angle relative to the base member.

10. The device of claim 1, wherein one or more of the support members is telescopingly adjustable.

11. The device of claim 1, wherein the inlet, the upper outlet, and the lower outlet of the conduit each include a quick connect coupling.

* * * * *